US005604814A

United States Patent [19]

Chen et al.

[11] Patent Number: 5,604,814

[45] Date of Patent: Feb. 18, 1997

[54] FLEXIBLE NECK MICROPHONE

[75] Inventors: Sun-Chih Chen; Sun-Jen Chen, both of Diamond Bar, Calif.

[73] Assignee: Midi Land, Inc., San Dimas, Calif.

[21] Appl. No.: 425,580

[22] Filed: Apr. 20, 1995

[51] Int. Cl.[6] ..... H04R 25/00

[52] U.S. Cl. ..... 381/169; 381/168

[58] Field of Search ..... 381/169, 168, 381/188, 205, 87, 88, 91, 122; 362/419, 420, 421, 396, 191, 190

[56] References Cited

U.S. PATENT DOCUMENTS

| | | | |
|---|---|---|---|
| D. 292,796 | 11/1987 | Rosenthal . | |
| 3,118,980 | 1/1964 | Hamson . | |
| 4,040,547 | 8/1977 | Dickey . | |
| 4,432,120 | 2/1984 | Sherman, Jr. et al. | 24/299 |
| 4,842,174 | 6/1989 | Sheppard et al. . | |
| 4,991,220 | 2/1991 | Wolf . | |
| 5,114,110 | 5/1992 | Vohora . | |
| 5,115,470 | 5/1992 | Sutheim | 381/205 |
| 5,276,596 | 1/1994 | Krenzel | 362/191 |
| 5,322,255 | 6/1994 | Garrett . | |

FOREIGN PATENT DOCUMENTS

| | | | |
|---|---|---|---|
| 1466506 | 1/1967 | France | 381/169 |

*Primary Examiner*—Sinh Tran
*Attorney, Agent, or Firm*—Sheldon & Mak

[57] ABSTRACT

A microphone fixture includes a base having a body, a base surface formed on the body, and an adhesive member affixed to the base surface for mounting the base in fixed relation to a supporting surface; an elongate curvable structure including an elongate ductile element that is manually formable to a desired shape of the curvable structure and made of solid copper wire of uniform cross-section, the curvable structure having a free length of at least approximately 14 inches; a microphone supported by the curvable structure proximate one end thereof and having electrical conductors for signalling operation of the microphone to an external device, the conductors extending within the curvable structure and from an opposite end thereof, the ductile element imparting sufficient stiffness to the curvable structure for supporting the microphone; an anchor formed of resilient material and fixedly connected to the opposite end of the curvable structure, a non-circularly cylindrical engagement surface being formed on the anchor, the conductors extending in a flexible cable from the anchor member opposite the curvable structure; and a yoke fixably projecting relative to the base and having an interference fit with the engagement surface for biasingly gripping the anchor relative to a portion of the curvable structure for releasably fixably connecting the curvable structure to the base while preventing rotation thereof, the microphone being adjustably supported in a desired position and orientation relative to the base.

14 Claims, 1 Drawing Sheet

FLEXIBLE NECK MICROPHONE

BACKGROUND

The present invention relates to microphone supports, and more particularly to such supports for locating a microphone in a desired position and orientation relative to a supporting surface.

Existing microphone supports include adjustable column stands, hangers, brackets, and clips. U.S. Pat. No. 4,842,174 to Sheppard et al. also discloses a flexible mount for apparatus such as a mobile telephone. The mount includes a semi-rigid tubular column having an upper flange for attachment of the apparatus, and a lower flange for anchoring to a supporting surface.

In situations wherein the microphone is to be used in association with other equipment such as a personal computer, a particular combination of problems makes impractical the use of existing microphone supports. For example:

1. Suitable locations for microphone brackets are severely restricted;

2. It is significantly undesirable to modify the equipment such as by drilling holes therein for receiving bracket mounting hardware;

3. Stands are unsuitable in that they are easily dislodged, and the microphone is often required to be located in horizontally offset relation to a supporting surface; and 4. Permanent microphone mounting is undesirable in that the presence of the microphone can physically interfere with some uses of the apparatus as well as maintenance thereof.

It is believed that none of the microphone supports of the prior art is effective for avoiding the above problems.

Thus there is a need for a microphone support that is suitable for anchoring to a restricted surface of apparatus such as a personal computer, that is effective for supporting the microphone in a desired relation to the supporting surface (including overhanging offset positions), that does not require modification of the apparatus, and that permits quick removal and replacement of the microphone in a way that leaves no significant obstructions impeding other uses of the apparatus.

SUMMARY

The present invention meets this need by providing a microphone fixture. In one aspect of the invention, the fixture includes a base having a body member, a base surface formed on the body member, and means for mounting the base in fixed relation to a supporting surface; an elongate curvable structure; a microphone supported by the curvable structure proximate one end thereof and having electrical conductors for signalling operation of the microphone to an external device, the conductors extending within the curvable structure and from an opposite end thereof; and means for releasably fixably connecting the curvable structure to the base, the microphone being adjustably supported in a desired position and orientation relative to the base.

The means for mounting the base can include an adhesive member affixed to the base surface. The base surface can be recessed within the base member, the adhesive member projecting from the base member. The adhesive member can include a resilient foam element, an adhesive material coating an exposed portion of the foam element.

The means for connecting can include a yoke member fixably projecting relative to the base, and an engagement surface fixably located relative to a portion of the curvable structure, the yoke member biasingly gripping the engagement surface. The fixture can further include an anchor member fixedly connected to the curvable structure, the engagement surface being formed on the anchor member. The anchor member can be connected proximate the opposite end of the curvable structure, the conductors extending in a flexible cable from the anchor member opposite the curvable structure. The anchor member can be coaxially located relative to the curvable structure. The anchor member can be formed of a resilient material, at least a portion of the engagement surface having an interference fit with the yoke member.

Preferably the engagement surface is cylindrical for axial engagement with the yoke member. Preferably the engagement surface is non-circularly cylindrical for preventing rotation of the curvable structure relative to the base.

The curvable structure can include an elongate ductile element manually formable to a desired shape of the curvable structure, the ductile element imparting sufficient stiffness to the curvable structure for supporting the microphone. The ductile element can form a portion of one of the conductors. The ductile element can be solid copper wire of uniform cross-section and having a stiffness at least approximately equivalent to AWG 16 round solid copper wire. The stiffness can be at least approximately equivalent to AWG 14 round solid copper wire. The curvable member further can include an outer sleeve member formed of a resilient electrically nonconducting material.

The curvable structure can have a free length of at least approximately 12 inches. The free length can be at least approximately 14 inches.

DRAWINGS

These and other features, aspects, and advantages of the present invention will become better understood with reference to the following description, appended claims, and accompanying drawings, where:

DESCRIPTION

Figures 1, 2, 3, 4:
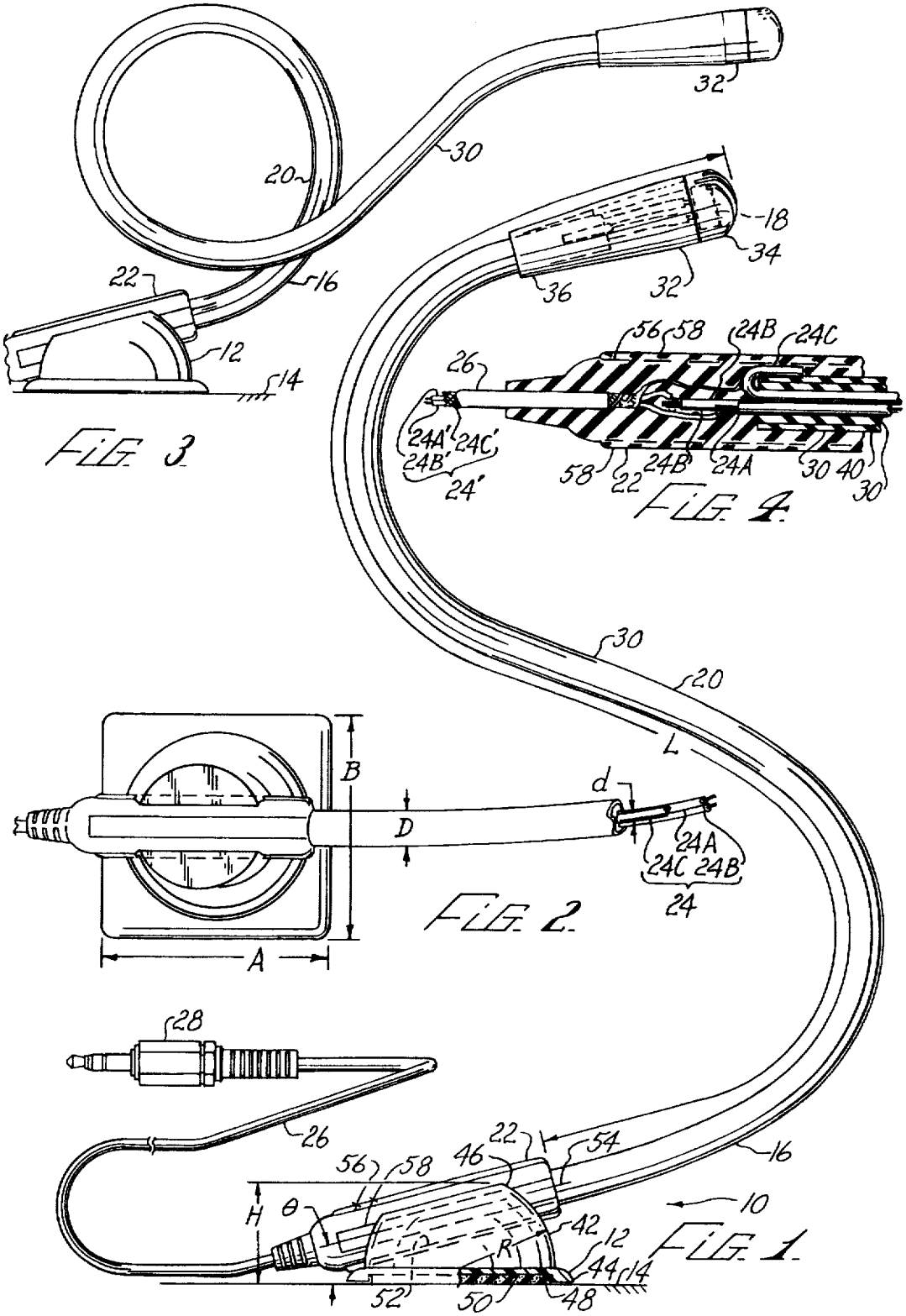
FIG. 1 is a side elevational view of a microphone support according to the present invention.
FIG. 2 is a partial top plan view of the microphone support of FIG. 1.
FIG. 3 is a partial side elevational view showing the microphone support of FIG. 1 in a differently adjusted position.
FIG. 4 is a lateral sectional detail view of a portion of the microphone support of FIG. 1.

The present invention is directed to a microphone support assembly that is particularly effective for use in connection with apparatus such as a personal computer. With reference to FIGS. 1–4 of the drawings, a microphone support assembly 10 includes a compact base 12 for affixing to a support surface 14, and a microphone stem unit 16 having a microphone 18 at a free end extremity of an adjustably curvable neck structure 20, an anchor member 22 that is releasably gripped by the base 12, the anchor member 22 being rigidly formed proximate an opposite end of the neck structure 20. A plurality of conductors 24, individually designated 24A, 24B, and 24C, extend within the neck structure 20 to one end of a flexible cable 26, a multi-pole coaxial connector jack 28 being located at a free end of the cable 26 for electrically connecting the microphone 18 to external equipment (not shown). The conductors 24 are connected to the cable 26 within the anchor member 22, the parts being molded in-situ within the anchor member 22 as shown in FIG. 4. It will be understood that although three conductors are shown, the microphone 18 has only two active connections, and further that while the cable 26 is shown as having a pair of conductors 24', designated 24A' and 24B' within a braided shield 24C', corresponding connections being made between the conductors 24 and 24', the cable 26 and the neck structure 22 are each required to have only two conductors.

The conductor 24C is configured as a relatively stiff ductile member for imparting a desired combination of stiffness and adjustability to the neck structure 22. Accordingly, a suitable configuration of the conductor 24C is a length of solid round copper wire of appropriate diameter d, 0.064 inch (AWG 14) being preferred for the neck structure 22 having a free length L of approximately 14.5 inches inclusive of the microphone 18. The neck structure 22 includes the conductors 24 as discussed above, and a flexible sleeve 30 that encloses the conductors 24. Also, a housing 32 having a slotted cap member 34 and a substantially cylindrical barrel 36 encloses the microphone 18 and a free end extremity of the sleeve 30, the housing 32 forming an extension of the neck structure 20 for supporting the microphone 18. The sleeve 30 is formed of an inner member 38 that is extruded about the conductors 24, and a cylindrical outer member 40 of diameter D that encloses the inner member 38. The conductor 24C, being connected to the braided shield 24C' of the cable 26, provides a degree of electromagnetic shielding for the conductors 24A and 24B.

The neck structure 20 can be formed straight or curved in an S-shape as shown in FIG. 1 or curved in a complete loop as shown in FIG. 3. Thus the microphone 18 can be positioned to project substantially the full length L from the base 12 and variously positioned as desired above and substantially closer to the base 12.

The base 12 includes a body 42 having a flange portion 44 and a clamp portion 46, and an adhesive member 48 being bonded within a shallow cavity 50 that is formed at the bottom of the flange portion 44. The flange portion 44 is rectangular, having a length A and a width B, the clamp portion 46 having a flattened hemispherical shape of radius R, the body 42 having a height H above the supporting surface 14. The length A and the width B can be slightly less than 2 inches, the height H being approximately 0.9 inch, the radius R being approximately 0.8 inch.

The adhesive member 48 projects slightly below the body 42 for fixedly contacting the support surface 14. A suitable material for the adhesive member 48 is a commercially available sheet of foam polymer having a suitable adhesive on opposite sides thereof. The sheet is normally supplied with protective paper (not shown) removably adhered to the adhesive, the paper having been removed from one side prior to affixing to the base 12.

The body portion is formed with a U-shaped channel 52 therethrough, the channel 52 having a longitudinal axis 54 that is inclined at an angle θ from the supporting surface 14 for axially receiving the anchor member 22. The channel 52 partially encloses and clampingly grips a cylindrical engagement surface 56 of the anchor member 22, the clamp portion 46 thus forming a yoke for releasably holding the anchor member 22. The engagement surface 56 is preferably non-circularly circular, the channel 52 being correspondingly formed for preventing rotation of the anchor member 22. More particularly, the anchor surface 56 includes one or more outwardly extending ribs 58, the channel 52 engaging at least two opposite sides of one or more of the ribs 58. As shown in the drawings, the ribs 58 are uniformly spaced about the longitudinal axis 54, the axis 54 being coaxially aligned with the neck structure 20. It will be understood that the term "cylindrical" means a surface generated by a straight line that moves parallel to a fixed line, such movement being not necessarily circular.

Suitable materials for the members 22, 38 and 40 include a variety of conventional polymers. For example, the inner member 38 can be formed of polyvinylchloride (PVC), and the outer member 40 can be formed of PVC.

Although the present invention has been described in considerable detail with reference to certain preferred versions thereof, other versions are possible. For example, an additional shield member such as a spiral foil strip can be wrapped over the conductors 24 (in electrical contact with the conductor 24C) for enhancing electrical shielding of the conductors 24A and 24B. Alternatively, the braided shield 24C' of the cable 26 can be omitted entirely for applications not requiring shielding. Therefore, the spirit and scope of the appended claims should not necessarily be limited to the description of the preferred versions contained herein.

What is claimed is:

1. A microphone fixture comprising:

(a) a base having a body member, a base surface formed the body member, and means for mounting the base with the base surface in fixed relation to a supporting surface;

(b) an elongate curvable structure comprising an elongate ductile element, the ductile element being manually formable to a desired shape of the curvable structure, the ductile element being of solid copper wire of uniform cross-section and having a stiffness of at least approximately equivalent to AWG 16 round solid copper wire, the curvable structure having a free length of at least approximately 12 inches;

(c) a microphone supported by the curvable structure proximate one end thereof and having an electrical conductor for signalling operation of the microphone to an external device, the conductors extending within the curvable structure and from an opposite end thereof, the ductile element imparting sufficient stiffness to the curvable structure for supporting the microphone;

(d) an anchor member fixedly connected to the opposite end of the curvable structure, an engagement surface being formed on the anchor member; and (e) a yoke member fixably projecting relative to the base, for biasingly gripping the engagement surface of the anchor member for releasably fixably connecting the curvable structure to the base, the microphone being adjustably supported in a desired position and orientation relative to the base.

2. The fixture of claim 1, wherein the means for mounting the base comprises an adhesive member affixed to the base surface.

3. The fixture of claim 2, wherein the adhesive member comprises a resilient foam element, an adhesive material coating an exposed portion of the foam element.

4. The fixture of claim 3, wherein the base surface is recessed within the body member, the adhesive member projecting from the body member.

5. The fixture of claim 1, wherein the conductors further extends in a flexible cable from the anchor member opposite the curvable structure.

6. The fixture of claim 5, wherein the anchor member is coaxially located relative to the curvable structure.

7. The fixture of claim 5, wherein the anchor member is formed of a resilient material, at least a portion of the engagement surface having an interference fit with the yoke member.

8. The fixture of claim 1, wherein the engagement surface is cylindrical for axial engagement with the yoke member.

9. The fixture of claim 8, wherein the engagement surface further comprise non-circularly cylindrical portions for preventing rotation of the curvable structure relative to the base.

10. The fixture of claim 1, wherein the ductile element forms a further conductor.

11. The fixture of claim 1, wherein the stiffness is at least approximately equivalent to AWG 14 round solid copper wire.

12. The fixture of claim 10, wherein the curvable member further comprises an outer sleeve member, the sleeve member being formed of a resilient electrically nonconducting material.

13. The fixture of claim 1, wherein the free length is at least approximately 14 inches.

14. A microphone fixture comprising:

(a) a base having a body member, a base surface formed on the body member, and an adhesive member affixed to the base surface for mounting the base in fixed relation to a supporting surface;

(b) an elongate curvable structure comprising an elongate ductile element, the ductile element being manually formable to a desired shape of the curvable structure, the ductile element being solid copper wire of uniform cross-section and having a stiffness at least approximately equivalent to AWG 16 round solid copper wire, the curvable structure having a free length of at least approximately 14 inches;

(c) a microphone supported by the curvable structure proximate one end thereof and having electrical conductors for signalling operation of the microphone to an external device, the conductors extending within the curvable structure and from an opposite end thereof, the ductile element imparting sufficient stiffness to the curvable structure for supporting the microphone;

(d) an anchor member fixedly connected to the opposite end of the curvable structure, the anchor member being formed of a resilient material, a non-circularly cylindrical engagement surface being formed on the anchor member, the conductors further extending in a flexible cable from the anchor member opposite the curvable structure; and (e) a yoke member fixably projecting relative to the base and having an interference fit with the engagement surface for biasingly gripping the anchor member relative to a portion of the curvable structure for releasably fixably connecting the curvable structure to the base while preventing rotation thereof, the microphone being adjustably supported in a desired position and orientation relative to the base.

* * * * *

UNITED STATES PATENT AND TRADEMARK OFFICE

CERTIFICATE OF CORRECTION

PATENT NO. : 5,604,814

DATED : February 18, 1997

INVENTOR(S): David B. Aragon

It is certified that error appears in the above-identified patent and that said Letters Patent is hereby corrected as shown below:

In Column 2, line 24, after "AWG", insert --(American Wire Gage)--.
In Column 4, at the end of line 24 after "formed", insert --on--; at line 61, change "conductors" to --conductor--.
In Column 5, line 6, change "comprise" to --comprises--.

Signed and Sealed this

Seventeenth Day of June, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,604,814

DATED : February 18, 1997

INVENTOR(S) : Sun-Chih Chen et al.

It is certified that error appears in the above-indentified patent and that said Letters Patent is hereby corrected as shown below:

In Column 2, line 24, after "AWG", insert --(American Wire Gage)--.
In Column 4, at the end of line 24 after "formed", insert --on--; at line 61, change "conductors" to --conductor--.
In Column 5, line 6, change "comprise" to --comprises--.

This certificate supersedes Certificate of Correction issued June 17, 1997.

Signed and Sealed this

Second Day of September, 1997

Bruce Lehman

*Attest:*

BRUCE LEHMAN

*Attesting Officer*

*Commissioner of Patents and Trademarks*